United States Patent [19]

Finken

[11] Patent Number: 4,675,685

[45] Date of Patent: Jun. 23, 1987

[54] LOW VSWR, FLUSH-MOUNTED, ADAPTIVE ARRAY ANTENNA

[75] Inventor: Kenneth R. Finken, Indialantic, Fla.

[73] Assignee: Harris Corporation, Melbourne, Fla.

[21] Appl. No.: 601,291

[22] Filed: Apr. 17, 1984

[51] Int. Cl.[4] ..... H01Q 1/28; H01Q 1/38

[52] U.S. Cl. ..... 343/708; 343/789; 343/853

[58] Field of Search ..... 343/789, 708, 700 MS, 343/829, 853, 846, 847, 830, 795, 797, 725, 711–713

[56] References Cited

U.S. PATENT DOCUMENTS

| | | | |
|---|---|---|---|
| 3,086,204 | 4/1963 | Alford | 343/708 |
| 3,478,362 | 11/1969 | Ricardi et al. | 343/708 |
| 3,541,559 | 11/1970 | Evans | 343/795 |
| 3,569,971 | 3/1971 | Griffee | 343/789 |
| 3,613,098 | 10/1971 | Blasko | 343/789 |
| 3,803,617 | 4/1974 | Fletcher et al. | 343/797 |
| 3,811,127 | 5/1974 | Griffee et al. | 343/797 |
| 4,042,935 | 8/1977 | Ajioka et al. | 343/797 |
| 4,193,077 | 3/1980 | Greenburg et al. | 343/797 |
| 4,218,685 | 10/1980 | Ellis | 343/789 |
| 4,287,518 | 9/1981 | Ellis | 343/708 |
| 4,418,351 | 11/1983 | Fackler | 343/797 |
| 4,460,894 | 7/1984 | Robin et al. | 343/700 MS |

*Primary Examiner*—Eli Lieberman
*Assistant Examiner*—Michael C. Wimer
*Attorney, Agent, or Firm*—Antonelli, Terry & Wands

[57] ABSTRACT

An electrically small, dual polarized, hemispherical coverage, multi-element adaptive array antenna exhibiting low VSWR and operational over an octave of bandwidth is flush-mounted with the airframe structure of high performance aircraft. The antenna is configured as a cavity type structure in the shape of a regular polygon and has a plurality of radiation elements mounted on an insulative support board, each of the elements being is connected to a respective output port for use in a multichannel adaptive array system. The array provides broadband capability of nulling interfering sources having arbitrary polarization and spatial direction.

29 Claims, 3 Drawing Figures

LOW VSWR, FLUSH-MOUNTED, ADAPTIVE ARRAY ANTENNA

The present invention was developed under a contract with the U.S. Air Force, AFWAL Contract No. F33615-81-C-1552.

FIELD OF THE INVENTION

The present invention relates in general to dual polarized, flush-mounted antennas, and is particularly directed to a multi-element adaptive array antenna for use in high performance aircraft that is compact, broadband, exhibits low VSWR and the radiation profile of which provides hemispherical coverage.

BACKGROUND OF THE INVENTION

Antenna design is generally based on intended performance and space constraints associated with its deployment, which typically include operational characteristics such as required bandwidth, radiation profile coverage, polarization and gain, as well as physical limitations such as size and weight. In an adaptive array, the elements must be closely spaced (usually about one-half wavelength) to avoid spurious (grating) nulls which may be inadvertently generated in the direction of the desired signal when nulling an interfering signal. Also, the array elements must be electrically small, in order that the radiation profile does not change appreciably with frequency. In addition the elements must be identically shaped and exhibit low VSWR, so that their performance tracks one another with frequency, thereby insuring broadband nulling of interference sources. These characteristics, when combined with octave band performance, are not compatible with conventional antenna configurations.

SUMMARY OF THE INVENTION

Pursuant to the present invention,, there is provided an electrically small, dual polarized, hemispherical coverage, flush mounted, multi-element adaptive array antenna exhibiting low VSWR which is operational over an octave of bandwidth. The antenna of the present invention is especially suited to be incorporated with the airframe structure of high performance aircraft. For this purpose the antenna is configured as a cavity type structure in the shape of a regular polygon and having a plurality of radiation elements mounted on a dielectric support board, each of the elements being connected to a respective output port for use in a multichannel adaptive array system. Such an array requires closely spaced, low VSWR, electrically similar elements which track each other with frequency so as to provide broadband capability of nulling interfering sources having arbitrary polarization and spatial direction. The above-mentioned, normally incompatible antenna requirements of small electrical size, broad (octave) bandwidth and low VSWR are achieved in the antenna of the present invention with a somewhat lower antenna efficiency by coupling to adjacent array elements. This loss of efficiency can be tolerated in an adaptive array since the interfering signal is reduced in the same proportion as the desired signal, thereby resulting in the same signal-to-interference ratio at each array element. (Downstream of the array this ratio will be significantly improved by the adaptive array signal processing electronics.)

DETAILED DESCRIPTION

Figure 1:
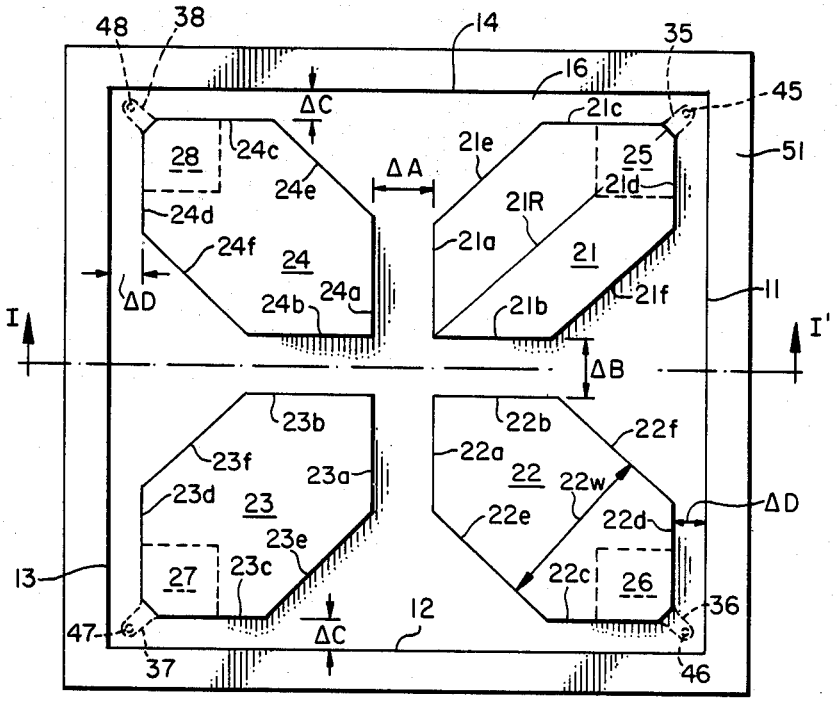
FIG. 1 is a top or plan view of the adaptive array antenna structure according to the present invention.
Figure 2:
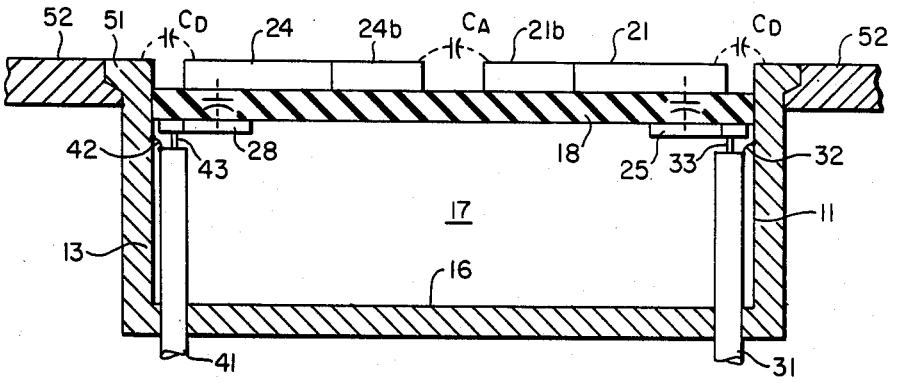
FIG. 2 is a sectional view of the antenna structure of the present invention taken along line I–I′ of FIG. 1.

Referring now to the drawings, an embodiment of the antenna array of the present invention is illustrated in FIGS. 1 and 2, FIG. 1 being a top or plan view of the multi-element array, while FIG. 2 is a side view taken along section line I–I′ of FIG. 1.

As shown in FIG. 1, the geometry of the antenna configuration is that of a square metallic cavity comprised of four contiguous side walls 11, 12, 13 and 14, and a bottom wall 16 integral with the side walls. The tops of the side walls are integral with a flange 51 which is adapted to be affixed to a ground plane, such as the conductive skin 52 of an aircraft, so that there is effectively provided a flush-mounting of the antenna with the surface of the airframe. The top surface of the antennas and the radiating elements need not be flat, but may be curved to match the contours of the aircraft. In those applications where a flush mounting is not required, the cavity is unnecessary and the radiating elements of the antenna can be fed directly against the ground plane.

As shown in FIG. 1, for a square cavity geometry, the array may consists of four elements 21, 22, 23 and 24, each of which is substantially hexagonally shaped and is formed of a thin layer of copper foil atop a printed circuit board 18. The sides of the board 18 may be affixed to the flange 51 at the top end of the walls 11–14 for support. Two adjacent corner edges of each element which are closest to the corners of the cavity, for example edges **21*c* and 21*d* for element 21, are spaced apart from the ground plane side walls (for example, walls 14 and 11 as shown in FIG. 1) by a prescribed separation distance $\Delta C$ and $\Delta D$. Thus, edges 22*c* and 23*c* of elements 22 and 23 are spaced by distance $\Delta C$ from side wall 12, whereas edges 23*d* and 24*d* of elements 23 and 24 are separated by a distance $\Delta D$ from side wall 13. Similarly, edge 22*d* and edge 24*c*, respectively, of element 22 and 24 are separated by distances $\Delta D$ and $\Delta C$ from side walls 11 and 14 of the cavity 17**, proper.

For purposes of describing an exemplary embodiment, the antenna configuration shown in FIG. 1 may operate over a bandwidth of 1,200–2,000 MHz. For this purpose, the cavity may be 4″ by 4″ square with a depth of $1\frac{3}{4}$″. The copper foil of which the elements are comprised may be very thin and electro formed on printed circuit board 18, as noted previously. The thickness of board 18 may be on the order of 0.032 inches.

On the opposite side of the printed circuit board adjacent the corners of the cavity and aligned with the respective copper foil antenna elements 21–24 are respective capacitive coupling elements 25–28. Each of these elements has a respective tab 35, 36, 37 and 38 with a respective feed through hole 45, 46, 47 and 48 for receiving the center conductor of a signal feed cable, such as a standard 50 ohm coaxial feed. As shown in FIG. 2, this may comprise a coaxial feed cable 31, the outer ground sleeve 32 of which is connected to the ground plane side wall 11, while the center conductor 33 is electrically connected at feed point 45 for coupling element 25. Similarly, coaxial feed cable 41 has its outer ground sleeve 42 connected to the cavity ground plane and its center conductor 43 joined to feed element 28 at feed through hole 48. In addition to being separated from the side walls of the cavity by respective distances ΔC and ΔD, at their corner edges, each of the elements is separated from an adjacent element by a prescribed linear separation along the opposite corner edges of the elements at the center portion of the pattern. Namely, adjacent intersecting corner edges 21*a* and 21*b* of antenna element 21 are separated from edge 24*a* of element 24 and edge 22*b* of element 22 by respective separation distances ΔA and ΔB, respectively. The same holds true for the other elements, as shown in FIG. 1.

These respective separations ΔA, ΔB, ΔC and ΔD as well as the size and shape of the elements relative to each other are adjusted to provide a desired input impedance (VSWR) for each element when all of the other elements are terminated in an impedance equivalent to that of the electronics to which the adaptive array will be eventually coupled (usually a 50 ohm resistive termination).

The size, shape and location of the elements is selected on an emperical basis with capacitive and inductive coupling between the elements iteratively adjusted, as necessary. Obviously, the separation will not be the same for every antenna structure, as the size, shape, location as well as the bandwidth and desired VSWR, will be tailored to the needs of the user. For purposes of the present exemplary embodiment and providing a general set of guidelines for implementing the present invention for changes in parametric values, the following procedure may be carried out.

The length of each element, namely the separation between effectively opposite corners taken along a lengthwise direction, such as along line 21R shown for element 21 in FIG. 1, and the capacitive coupling $C_A$(-proximity) of the edges of the element to adjacent elements (namely separations ΔA and ΔB) are adjusted to provide the desired input resistance level at the low end of the frequency band. Next, the shunt capacitance of the element to the grounded side of the feed circuit (namely the capacitance $C_D$ across the separation between the corner edges of the element and the side cavity walls (separations ΔC and ΔD) is adjusted to provide the same input resistance level at the high frequency end of the band of interest. As noted above, this shunt capacitance is primarily controlled by the spacing (ΔC and ΔD) between the element and the cavity wall, and to a lesser extent by the width of the element. For the 4″×4″ layout shown in FIG. 1, operational over a frequency band of 1,2000–2,000 MHz, the separations ΔC and ΔD between the edges of the antenna elements 21–24 and the respective side walls of the cavity may be on the order of 0.062 inches. Also the separations ΔA and ΔB between the edges of adjacent elements may be on the order of 0.312 inches. As shown in FIG. 1, the width of element 22 is the separation along line 22*w* between side parallel edges 22*e* and 22*f*. The same width measurement applies to the remaining elements 21, 23 and 24.

For the exemplary embodiment of the present invention described herein the width of each element (e.g. width 22*w* of element 22) is on the order of 1.20 inches. Also the area of each capacitor coupling element relative to that of the radiation element may be on the order of 0.25 square inches. Thus, capacitive coupling element 25 has dimensions of 0.50 inches, along the lengths of edges 21*c* and 21*d* of radiation element 21, which may be on the order of 0.85 inches, and equal to those of edge 21*a* and 21*b* at the opposite end of element 21. The same size measurement relationships apply to elements 22, 23 and 24.

After establishing the capacitive coupling at the end of the element, the input element capacitance and the shunt capacitance, the inductive reactance of an element over the entire band is cancelled by a series capacitance at the feed point. As shown in FIG. 2, this series capacitance is formed by the size and shape of the feed elements 25 and 28 and their separation through the printed circuit board to their adjacent antenna elements 21 and 24. It should be observed that in some applications this series capacitance may not be necessary and the antenna element may be directly connected to the feed wire center conductor at the feed point.

Figure 3:
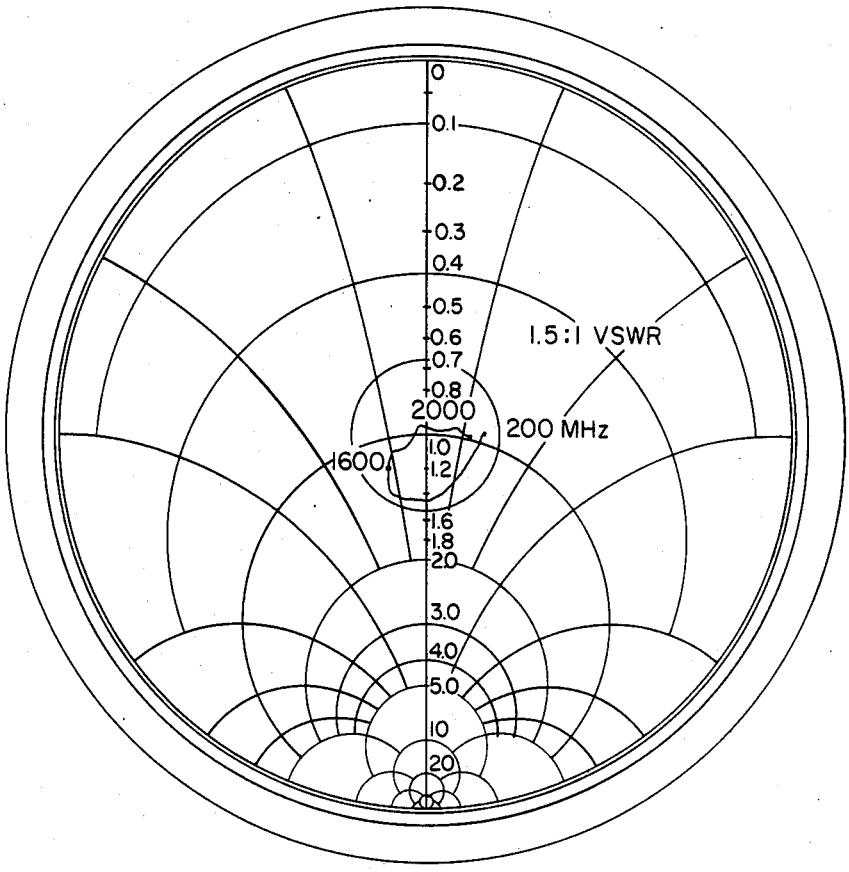
FIG. 3 is a Smith Chart plot of the performance of the antenna configuration of FIG. 1.

Once the above adjustment of impedance matching parameters has been completed to establish desired capacitance coupling and inductive reactance, a minor readjustment of each parameter may be carried for an optimum impedance match for the particular cavity size and frequency band desired. A near optimum adjustment exists when there is one loop in the input impedance curve (as plotted on a Smith Chart such as shown in FIG. 3 and referenced to the element feed point) and this loop is centered about the center of the chart with the low and high ends of the frequency band being nearly coincident.

For the exemplary embodiment described here, a VSWR of less than 1.5:1 is obtainable over nearly an octave of frequency band, using a four element array shown in FIGS. 1 and 2, in a cavity that is approximately 0.4 wavelengths square at the low frequency.

It should be observed that the coupling to adjacent elements represents a loss in antenna efficiency since energy is dissipated in the resistive termination on these adjacent elements. This coupling has been measured and the lost energy was found to be less than 3 dB over the full frequency range. Of course, the amount of energy lost due to this coupling (antenna efficiency) is a function of the number of adaptive elements in the array, cavity size in terms of wavelength, and the antenna bandwidth. For changes in the configuration of the antenna array, these various factors must be taken into account.

While the embodiment of the invention shown in FIGS. 1 and 2 is a square metallic cavity having four array elements, other configurations may be employed. For example, the cavity may be a circular cavity having a plurality of identical, equally spaced elements distributed therein. Similarly, the cavity may be in the shape of a regular polygon other than a square with the number of sides corresponding to the number of elements of the array. In each instance, the elements may be fed from the corners of the cavity (it being noted that there are no corners in the circular configuration) or the side walls. The radiating elements need not be etched on a printed circuit board but may be made of any electrical conductor. Also, they need not be flat, but may be curved to fit any desired contour.

When deployed in a high performance aircraft, the antenna of the present invention is generally used for receive applications. When used as an adaptive transmitting antenna, isolators may be used at each antenna port to provide the required input impedance for each adaptive transmitter source.

As described above, for the embodiment of the invention shown in FIGS. 1 and 2, the Smith Chart shown in FIG. 3 illustrates a VSWR of less than 1.5:1 over nearly an octave of frequency band (i.e. 1,200–2,000 MHz). Using substantially the same design shown in FIGS. 1 and 2, a VSWR of approximately 2.0:1 was obtained over a full octave (950–1,900 MHz) frequency band for a four inch square cavity with slightly less antenna efficiency (3.4dB maximum loss). It will be readily appreciated, therefore, that the present invention offers a substantial performance improvement over conventional antenna matching techniques and structures heretofore proposed.

While I have shown and described an embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed:

1. An antenna comprising:

a support member; and an arrangement of a plurality of at least three separate electromagnetic wave radiation elements symmetrically distributed in a prescribed pattern on said support member so as to define a prescribed radiating aperture of the antenna and being spaced apart at a perimeter of said arrangement from a conductive member, which conductive member provides a conductive reference plane for said elements adjacent to the perimeter of the arrangement of said elements on said support member; and wherein each of said elements includes means for electrically coupling that respective element, at a first edge portion thereof lying in said prescribed radiating aperture and adjacent to said conductive member, to a respective signal coupling device for controlling the electromagnetic wave radiation characteristic of that element, and wherein each of said elements has a second, rectilinear edge portion thereof spaced apart from and capacitively coupled to a rectilinear edge portion of an adjacent element in an interior region of said arrangement.

2. An antenna according to claim 1, wherein sid prescribed pattern of elements comprises four such elements each of which has a pair of parallel side portions connecting first and second edge portions thereof, and wherein the angular relationship between the side portions of adjacent elements is effectively 90°.

3. An antenna according to claim 2, wherein said conductive member is adapted to be coupled with a portion of the periphery of a vehicle so that said antenna is effectively flush-mounted to said vehicle.

4. An antenna according to claim 1, wherein said support member comprises a thin board of insulation material on one face of which said plurality of electromagnetic radiation elements are arranged in said prescribed pattern and on an opposite face of which are provided respective layers of conductive material so as to be capacitively coupled to respective ones of said elements for providing electrical coupling between said elements and respective signal coupling devices.

5. An antenna according to claim 1, wherein said conductive member comprises a conductive-walled cavity having a side wall portion and a base portion integral therewith and being adapted to be coupled with said support member such that a first edge portion of each of said elements is spaced apart from the side wall portion of said conductive-walled cavity.

6. An antenna according to claim 5, wherein said conductive walled cavity is adapted to be coupled with a portion of the periphery of a vehicle so that said antenna is effectively flush-mounted to said vehicle.

7. An antenna according to claim 6, wherein said prescribed pattern of elements comprises four such elements each of which has a pair of parallel side portions connecting first and second edge portions thereof, and wherein the angular relationship between the side portions of adjacent elements is effectively 90°.

8. An antenna according to claim 7, wherein said support member comprises a thin board of insulation material on one face of which said plurality of electromagnetic radiation elements are arranged in said prescribed pattern and on an opposite face of which are provided respective layers of conductive material so as to be capacitively coupled to respective ones of said elements for providing electrical coupling between said elements and respective signal coupling devices.

9. An antenna according to claim 1, wherein said conductive member has a substantially rectangular-shaped opening therein, in which opening said prescribed pattern of elements is adapted to be supported by said support member, and wherein said prescribed pattern of elements comprises four such elements each of which is substantially hexagonally shaped, a respective element having its first edge portion adjacent a respective corner of said substantially rectangular-shaped opening of said conductive member.

10. An antenna according to claim 9, wherein said support member comprises a thin board of insulation material on one face of which said plurality of electromagnetic radiation elements are arranged in said prescribed pattern and on an opposite face of which are provided respective layers of conductive material so as to be capacitively coupled to respective ones of said elements for providing electrical coupling between said elements and respective signal coupling devices.

11. An antenna according to claim 10, wherein said conductive member is adapted to be coupled with a portion of the periphery of a vehicle so that said antenna is effectively flush-mounted to said vehicle.

12. An antenna according to claim 11, wherein said conductive member comprises a conductive-walled cavity having a side wall portion and a base portion integral therewith and being adapted to be coupled with said support member such that a first edge portion of each of said elements is spaced apart from the side wall portion of said conductive-walled cavity.

13. An antenna according to claim 9, wherein the opening in said conductive member is substantially square-shaped.

14. An antenna according to claim 1, wherein said conductive member has a substantially regular polygon-shaped opening therein, in which opening said prescribed pattern of elements is adapted to be supported by said support member, and wherein said prescribed pattern of elements comprises a number of such elements equal in number to the number of sides of said polygon, and wherein each of said elements is shaped in a prescribed manner, a respective element having a first edge portion adjacent a respective corner of said opening in said conductive member.

15. An antenna comprising:

a conductive member having a substantially regular polygon-shaped opening therein;

a plurality N of separate electromagnetic wave radiation elements arranged in a prescribed pattern, the number N of said elements corresponding to the number of sides of said polygon, respective ones of said elements being supported in said opening so as to be adjacent to but spaced apart from the corners of said substantially regular polygon-shaped opening in said conductive member; and wherein each of said elements includes means for electrically coupling that respective element at a first portion thereof adjacent a respective corner of said opening in said conductive member, to a respective signal coupling device for controlling the electromagnetic wave radiation characteristic of that element.

16. An antenna according to claim 15, wherein said first portion of a respective element is adjacent to an edge portion thereof, which edge portion is substantially parallel with but spaced apart from a side of said polygon-shaped opening in said conductive member.

17. An antenna according to claim 15, further including a substantially flat insulative support member, upon which said elements are arranged in said prescribed pattern, structurally coupled with said conductive member.

18. An antenna according to claim 17, wherein said conductive member is adapted to be coupled with a portion of the periphery of a vehicle so that said antenna is effectively flush-mounted to said vehicle.

19. An antenna according to claim 17, wherein said support member comprises a thin board of insulation material on one face of which said plurality of electromagnetic radiation elements are arranged in said prescribed pattern and on an opposite face of which are provided respective layers of conductive material so as to be capacitively coupled to respective ones of said elements for providing electrical coupling between said elements and respective signal coupling devices.

20. An antenna according to claim 17 wherein said conductive member comprises a conductive-walled cavity having a plurality of contiguous side wall portions defining said substantially regular-polygon shaped opening thereby, and a base portion integral with said side wall portions, and being adapted to be structurally coupled with said support member such that said first portion of a respective element is adjacent to an edge portion thereof, which edge portion is substantially parallel with but spaced apart from a side wall portion of said cavity.

21. An antenna according to claim 17, wherein said conductive member comprises a conductive-walled cavity having a side wall portion and a base portion integral therewith and being adapted to be coupled with said support member such that a first edge portion of each of said elements is spaced apart from the side wall portion of said conductive-walled cavity.

22. An antenna according to claim 21 wherein said support member comprises a thin board of insulation material on one face of which said plurality of electromagnetic radiation elements are arranged in said prescribed pattern and on an opposite face of which are provided respective layers of conductive material so as to be capacitively coupled to respective ones of said elements for providing electrical coupling between said elements and respective signal coupling devices.

23. An antenna according to claim 15, wherein each of said elements is shaped in a prescribed manner, with a respective corner thereof aligned with a corner of said polygon-shaped opening.

24. An antenna comprising:

a conductive member having an opening therein;

an arrangement of a plurality of at least three seperate electromagnetic wave radiation elements symetrically distributed in a prescribed pattern, respective ones of said elements being supported in said opening so as to define a prescribed radiating aperature of the antenna and being adjacent to but spaced apart from the periphery of said opening in said conductive member; and wherein each of said elements includes means for electrically coupling that respective element, at a first edge portion thereof lying in said predescribed radiating aperture and adjacent to the periphery of said opening in said conductive member, to a respective signal coupling device for controlling the electromagnetic wave radiation characteristic of that element, and wherein each of said elements has a second rectilinear edge portion thereof spaced apart from and capacitively coupled to a rectilinear edge portion of an adjacent element in an interior region of said arrangement.

25. An antenna according to claim 24, wherein said first portion of a respective element is adjacent to an edge portion thereof, which edge portion is substantially parallel with but spaced apart from the periphery of said opening in said conductive member.

26. An antenna according to claim 24, further including a substantially flat insulative support member, upon which said elements are arranged in said prescribed pattern, structurally coupled with said conductive member.

27. An antenna according to claim 26, wherein said conductive member is adapted to be coupled with a portion of the periphery of a vehicle so that said antenna is effectively flush-mounted to said vehicle.

28. An antenna according to claim 26, wherein said support member comprises a thin board of insulation material on one face of which said plurality of electromagnetic radiation elements are arranged in said prescribed pattern and on an opposite face of which are provided respective layers of conductive material so as to be capacitively coupled to respective ones of said elements for providing electrical coupling between said elements and respective signal coupling devices.

29. An antenna according to claim 26, wherein said conductive member comprises a conductive-walled cavity having a plurality of contiguous side wall portions defining a substantially regular-polygon shaped opening thereby, and a base portion integral with said side wall portions, and being adapted to be structurally coupled with said support member such that said first portion of a respective element is adjacent to an edge portion thereof, which edge portion is substantially parallel with but spaced apart from a side wall portion of said cavity.

* * * * *